US005467877A

United States Patent [19]

Smith

[11] Patent Number: 5,467,877

[45] Date of Patent: Nov. 21, 1995

[54] BABY BOTTLE WITH RECESSED BOTTOM FOR THE REMOVABLE RECEIPT OF A COLD SUBSTANCE

[76] Inventor: Thomas C. Smith, 3815 Cottonwood, Longview, Wash. 98632

[21] Appl. No.: 260,241

[22] Filed: Jun. 14, 1994

[51] Int. Cl.[6] ..... F25D 3/08

[52] U.S. Cl. ..... 215/11.1; 62/457.3; 220/506

[58] Field of Search ..... 215/10, 11.1, 12.1; 62/457.3, 457.4, 457.7, 457.8; 220/506, DIG. 10

[56] References Cited

U.S. PATENT DOCUMENTS

| | | | |
|---|---|---|---|
| 1,182,042 | 5/1916 | Rubin | 215/12.1 X |
| 2,075,137 | 3/1937 | Rosen | 62/457.3 X |
| 2,187,558 | 1/1940 | Kushima | 62/457.3 X |
| 2,526,165 | 10/1950 | Smith | 62/457.3 X |
| 2,786,769 | 3/1957 | Greenspan | 215/11.1 X |
| 5,044,173 | 9/1991 | Cheng | 62/457.3 X |
| 5,129,238 | 7/1992 | Schwartz et al. | 62/457.3 |
| 5,189,892 | 3/1993 | Roberts | 62/457.3 X |
| 5,244,122 | 9/1993 | Botts | 215/11.1 X |

*Primary Examiner*—Steven M. Pollard

[57] ABSTRACT

A baby bottle with recessed bottom for the removable receipt of a cold substance comprising a baby bottle having a main body portion with a side wall having a cylindrical cross-sectional configuration over the majority of its extent, the main body portion having a closed lower end forming a base with a flat surface perpendicular to the axis of the side wall and with an open upper end, with threads formed exteriorly on the open upper end; and a cylindrical extension formed within the interior of the bottle between the side walls from the central portion of the base.

1 Claim, 4 Drawing Sheets

BABY BOTTLE WITH RECESSED BOTTOM FOR THE REMOVABLE RECEIPT OF A COLD SUBSTANCE

BACKGROUND OF THE INVENTION

1. Field of the Invention

The present invention relates to a baby bottle with recessed bottom for the removable receipt of a cold substance and more particularly pertains to retaining the contents of a baby bottle cold over a long period through the use of a frozen material removably inserted in a recess extending upwardly from the bottom of a baby bottle.

2. Description of the Prior Art

The use of a wide variety of baby bottles and other devices from which beverages may be drunk and in which provisions are made for retaining the coldness of the beverage is known in the prior art. More specifically, a wide variety of baby bottles and other devices from which beverages may be drunk and in which provisions are made for retaining the coldness of the beverage heretofore devised and utilized for the purpose of maintaining the contents of baby bottles or other containers cold through appropriate design configurations of the bottles or other similar-type containers are known to consist basically of familiar, expected, and obvious structural configurations, notwithstanding the myriad of designs encompassed by the crowded prior art which has been developed for the fulfillment of countless objectives and requirements.

By way of example, the prior art discloses in U.S. Pat. No. 4,816,048 a quick cooling insert.

U.S. Pat. No. 4,867,325 discloses a baby bottle having a generally toroidal hollow chamber.

U.S. Pat. No. 5,067,328 discloses a cooling vessel for beverages.

U.S. Pat. No. 5,156,284 discloses a thermally insulated baby bottle.

U.S. Pat. No. 308,617 discloses the design of a baby bottle cooler.

In this respect, the baby bottle with recessed bottom for the removable receipt of a cold substance according to the present invention substantially departs from the conventional concepts and designs of the prior art, and in doing so provides an apparatus primarily developed for the purpose of retaining the contents of a baby bottle cold over a long period through the use of a frozen material removably inserted in a recess extending upwardly from the bottom of a baby bottle.

Therefore, it can be appreciated that there exists a continuing need for a new and improved baby bottle with recessed bottom for the removable receipt of a cold substance which can be used for retaining the contents of a baby bottle cold over a long period through the use of a frozen material removably inserted in a recess extending upwardly from the bottom of a baby bottle. In this regard, the present invention substantially fulfills this need.

SUMMARY OF THE INVENTION

In view of the foregoing disadvantages inherent in the known types of a wide variety of baby bottles and other devices from which beverages may be drunk and in which provisions are made for retaining the coldness of the beverage now present in the prior art, the present invention provides an improved baby bottle with recessed bottom for the removable receipt of a cold substance. As such, the general purpose of the present invention, which will be described subsequently in greater detail, is to provide a new and improved baby bottle with recessed bottom for the removable receipt of a cold substance and method which has all the advantages of the prior art and none of the disadvantages.

To attain this, the present invention essentially comprises a new and improved baby bottle with recessed bottom for the removable receipt of a cold substance comprising, in combination, a baby bottle having a main body portion with a side wall having a cylindrical cross-sectional configuration over the majority of its extent, the main body portion having a closed lower end forming a base with a flat surface perpendicular to the axis of the side wall and with an open upper end, with threads formed exteriorly on the open upper end; a cylindrical extension formed within the interior of the bottle between the side walls from the central portion of the base, the extension extending for about fifty percent of the length of the bottle; screw threads formed in the exterior surface of the main body portion adjacent to the lower end thereof; a nipple with a hole at its upper end and a radially extending flange at its lower end; a nipple cap formed with a circular aperture for the passage therethrough of the nipple and a downwardly extending flange with internal threads to removably couple the nipple and cap to the upper end of the bottle during use; a cylindrical insert of a cold frozen material positionable within the recess, the insert being of a length essentially the same as that of the recess with a diameter slightly less than the interior diameter of the recess; and an imperforate cap with a planar central circular portion and an upstanding peripheral wall with internal threads adapted to mate with the external threads at the lower end of the main body portion to preclude inadvertent removal of the insert material from the recess.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent of legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved baby bottle with recessed bottom for the removable receipt of a cold substance which has all the advantages of the prior art a wide variety of baby bottles and other devices from which beverages may be drunk and in which provisions are made for retaining the coldness of the beverage and none of the disadvantages.

It is another object of the present invention to provide a new and improved baby bottle with recessed bottom for the removable receipt of a cold substance which may be easily and efficiently manufactured and marketed.

It is further object of the present invention to provide a new and improved baby bottle with recessed bottom for the removable receipt of a cold substance which is of durable and reliable constructions.

An even further object of the present invention is to provide a new and improved baby bottle with recessed bottom for the removable receipt of a cold substance which is susceptible of a low cost of manufacture with regard to both materials and labor, and which accordingly is then susceptible of low prices of sale to the consuming public, thereby making such baby bottle with recessed bottom for the removable receipt of a cold substance economically available to the buying public.

Still yet another object of the present invention is to provide a new and improved baby bottle with recessed bottom for the removable receipt of a cold substance which provides in the apparatuses and methods of the prior art some of the advantages thereof, while simultaneously overcoming some of the disadvantages normally associated therewith.

Still another object of the present invention is to retain the contents of a baby bottle cold over a long period through the use of a frozen material removably inserted in a recess extending upwardly from the bottom of a baby bottle.

Lastly, it is an object of the present invention to provide a new and improved baby bottle with recessed bottom for the removable receipt of a cold substance comprising a baby bottle having a main body portion with a side wall having a cylindrical cross-sectional configuration over the majority of its extent, the main body portion having a closed lower end forming a base with a flat surface perpendicular to the axis of the side wall and with an open upper end, with threads formed exteriorly on the open upper end; and a cylindrical extension formed within the interior of the bottle between the side walls from the central portion of the base.

These together with other objects of the invention, through the use of a frozen material removably inserted in a recess extending upwardly from the bottom of a baby bottle with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
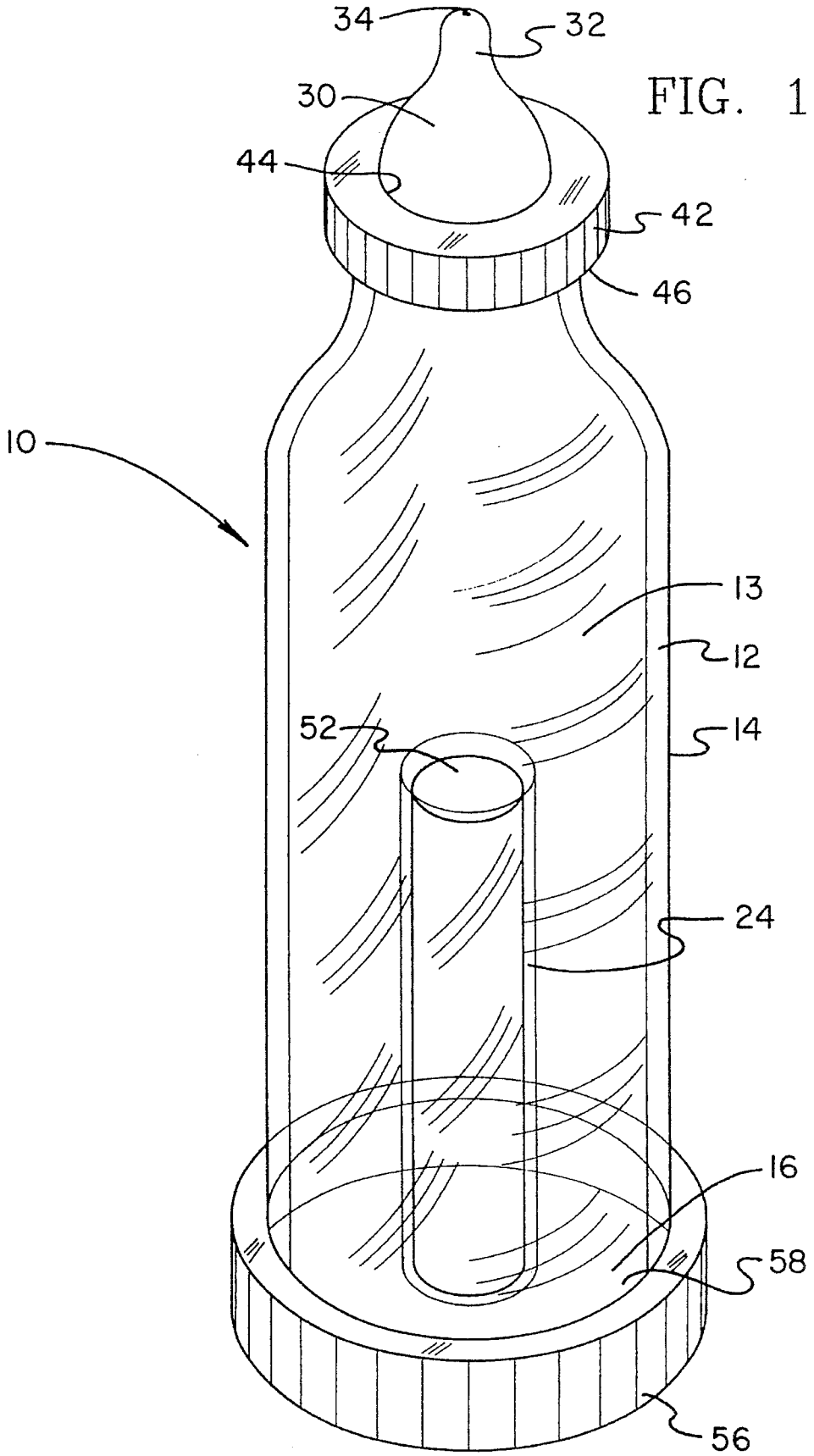
FIG. 1 is a perspective view of the preferred embodiment of the new and improved baby bottle with recessed bottom for the removable receipt of a cold substance constructed in accordance with the principles of the present invention.
Figure 2:
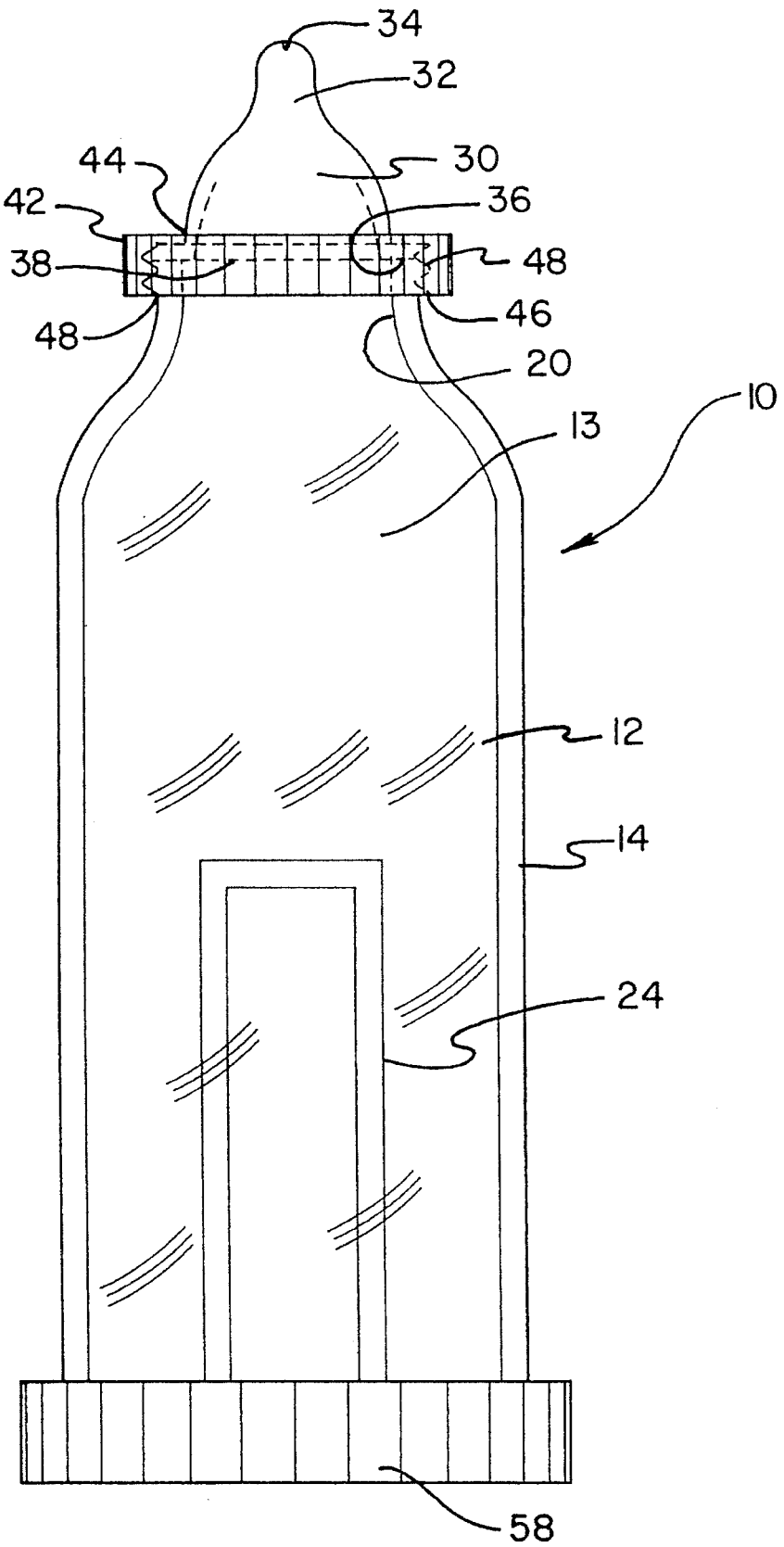
FIG. 2 is front elevational view of the baby bottle shown in FIG. 1.
Figure 5:
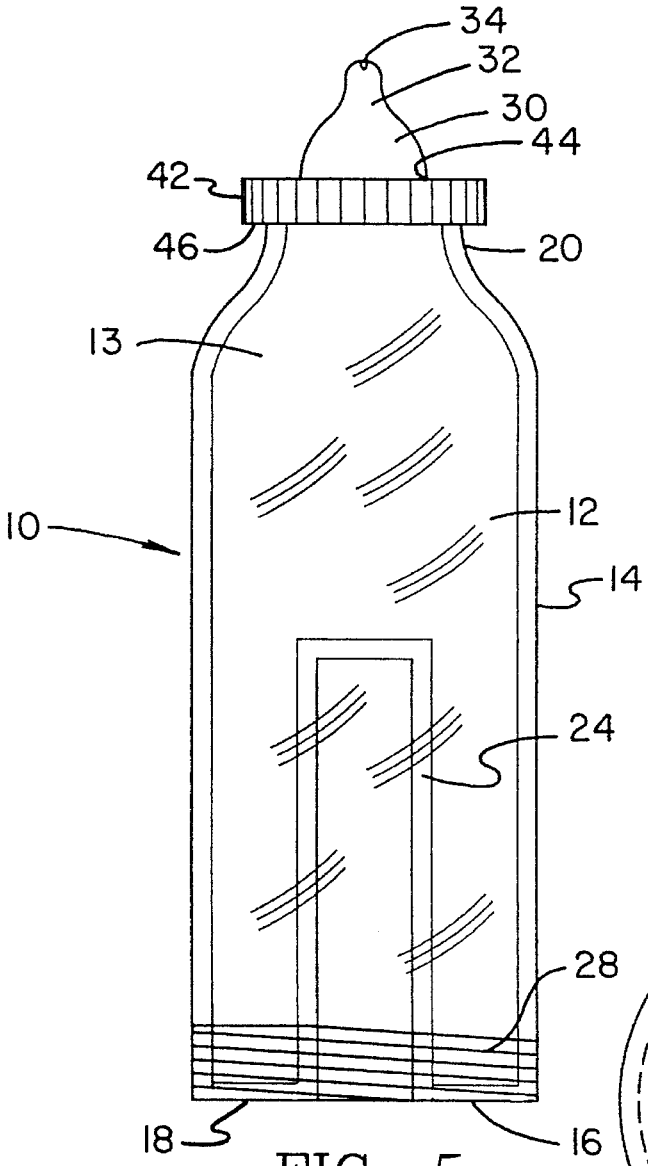
FIG. 5 is a side elevational view of the baby bottle with the lower end cap removed.
Figure 3:
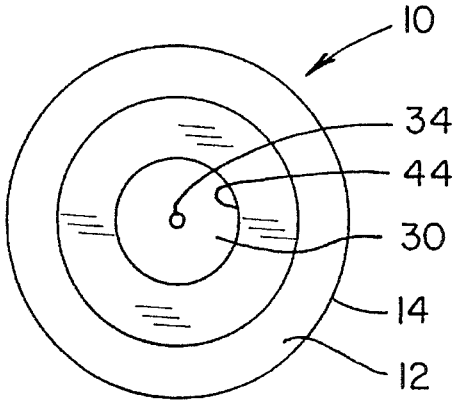
FIG. 3 is a top plan view of the baby bottle shown in FIGS. 1 and 2.
Figure 4:
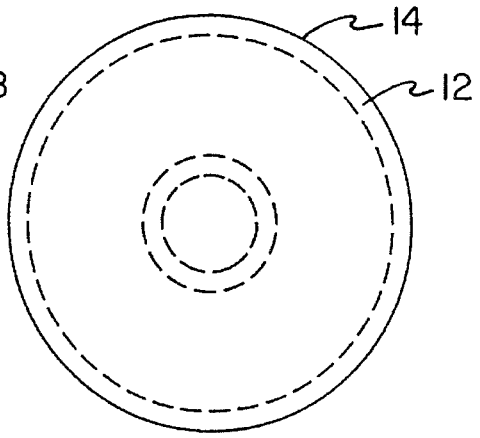
FIG. 4 is bottom view of the baby bottle illustrated in FIGS. 1, 2 and 3.
Figure 6:
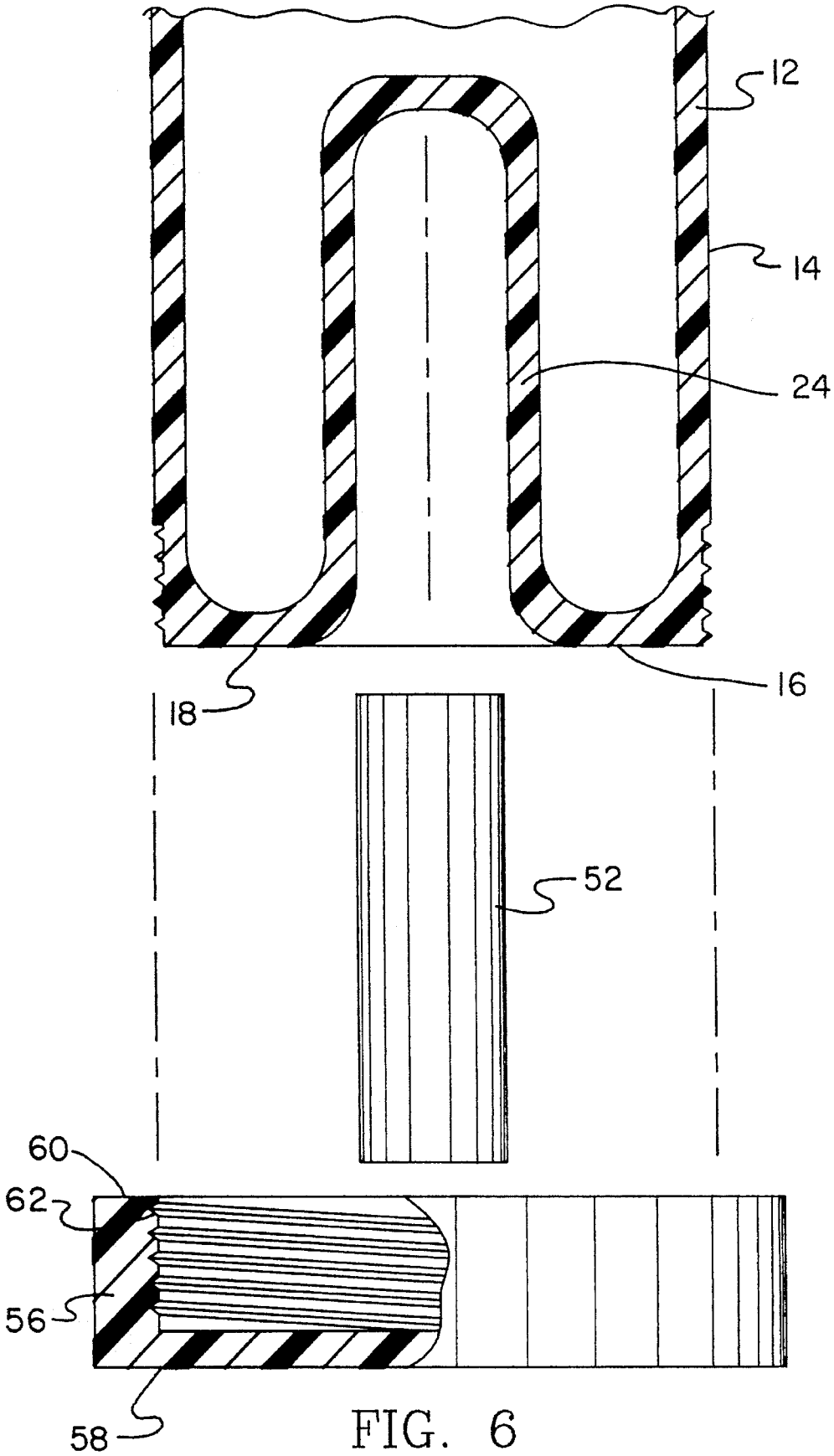
FIG. 6 is an exploded cross-sectional view of the lower portion of the baby bottle of the prior Figures showing the lower portion of the baby bottle, the end cap and the insert material.

With reference now to the drawings, and in particular to FIG. 1 thereof, the preferred embodiment of the new and improved baby bottle with recessed bottom for the removable receipt of a cold substance embodying the principles and concepts of the present invention and generally designated by the reference numeral 10 will be described.

The present invention, the new and improved baby bottle with recessed bottom for the removable receipt of a cold substance, is comprised of a plurality of components. Such components in their broadest context include a baby bottle, a cylindrical extension, exterior screw threads, a nipple, a nipple cap, a cylindrical insert and an imperforate cap. Such components are individually configured and correlated with respect to each other so as to attain the desired objective.

More specifically, it will be noted in the various Figures that the central component of the system 10 of the present invention is a baby bottle 12. The baby bottle has a main body portion 13. The main body portion is formed with a side wall 14 having a cylindrical cross-section. The cylindrical cross-section exists over the majority of its extent through the central portion thereof. The main body portion also has a closed lower end 16 forming a base 18. The base is a flat surface perpendicular to the axis of the side wall. The main body portion also has an open upper end 20. Threads are formed exteriorly on the open upper end.

The function of the bottle in retaining contents cold is effected through a cylindrical extension 24. The cylindrical extension is formed within the interior of the bottle. It is essentially located between the side walls for cooling all adjacent areas of liquid within the bottle. This cylindrical extension extends upwardly from the central portion of the base. The extension extends upwardly from the base to a distance of about fifty percent of the length of the bottle, plus or minus ten percent.

Also formed on the main body portion are screw threads 28. The screw threads are formed on the exterior surface of the main body portion adjacent to the lower end or base thereof.

For use in association with the baby bottle, there is provided a nipple 30. The nipple is symmetrically formed about a central axis adapted to be co-incident with the axis of the main body portion. The nipple has an upper end 32 with a central hole 34 therein for dispensing fluid to a baby. The nipple also has a radially extending flange 36 at its lower end 38.

In association with the nipple and main body portion there is also provided a nipple cap 42. The nipple cap is formed with a circular aperture 44 for the passage of the nipple therethrough. The cap also has a downwardly extending flange 46 in a cylindrical configuration. The flange has internal threads 48 for effecting the removable coupling thereof along with the nipple to the upper end of the bottle during use and feeding of a baby.

Utility is provided to the cylindrical extension through the use of a cylindrical insert 52. The insert is of a cold frozen material such as ice or material other than water in a frozen state. A large number of equivalent materials could be utilized for cooling the contents of the bottle. The insert has a cross-sectional configuration essentially the same as that of the extension. The insert is positionable within the recess. The insert is of a length essentially the same as that of the recess or, preferably, slightly larger. The insert has a diameter slightly less than the interior diameter of the recess.

The last component of the system is an imperforate cap 56. The imperforate cap is formed with a planar central circular portion 58 and upstanding peripheral walls 60. The peripheral walls are in a cylindrical configuration. The peripheral walls have internal threads 62. Such threads are adapted to mate with the external threads at the lower end of the main body portion. When so positioned, the imperforate cap functions to preclude inadvertent removal of the insert material from the recess to allow the insert material to function properly for its intended purpose of cooling the contents of the bottle.

The present invention comprises a stay cold bottle which is very similar in appearance to the overall appearance of an ordinary baby bottle. The difference is in the configuration of its base and its clever employment of an ice pack. It features a small cylindrical ice pack core to fulfill this special need.

The base itself is a threaded cap that is installed by means of matching threads at the bottom of the bottle. The center of the cap is molded with a small ring to support and retain the ice pack. The ice pack is simply a reusable, sealed cylinder of a non-toxic substance that is nearly identical in composition to its larger counterparts.

To use the present invention, the ice pack is first frozen and then placed into the space provided for it, effectively creating a cold center core in the bottle. Then the bottle is filled with the liquid refreshment and the cap is secured to the bottle. The location of the ice pack core keeps the liquid uniformly cold for extended periods of time. It simply reduces the risk of a baby's formula or beverage becoming spoiled from the lack of refrigeration.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A new and improved baby bottle with a recessed bottom for the removable receipt of a cold substance comprising, in combination:

a baby bottle having a one piece main body portion with a side wall with concentric interior and exterior surfaces and having a cylindrical cross-sectional configuration over the majority of its extent, the main body portion having a closed lower end forming a base with a flat surface perpendicular to the axis of the side wall and with an open upper end of a reduced diameter, with screw threads formed exteriorly adjacent to the open upper end;

a cylindrical extension formed within the interior of the bottle between the side walls from the central portion of the base, the extension extending for about fifty percent of the length of the bottle;

screw threads formed in the exterior surface of the main body portion adjacent to the lower end thereof, the screw threads adjacent to the lower end being of a greater diameter than the screw threads adjacent to the upper end;

a nipple with a hole at its upper end and a radially extending flange at its lower end;

a nipple cap formed with a circular aperture for the passage therethrough of the nipple and a downwardly extending flange with internal threads to removably couple the nipple and cap to the upper end of the bottle during use;

a cylindrical insert of a cold frozen material positionable within the recess, the insert being of a length essentially the same as that of the recess with a diameter slightly less than the interior diameter of the recess; and a separate imperforate cap with a planar central circular portion and an upstanding peripheral wall with internal threads adapted to mate with the external threads at the lower end of the main body portion to preclude inadvertent removal of the insert material from the recess and to present a smooth continuous closed lower surface for the safety of a baby handling the baby bottle.

* * * * *